United States Patent [19]

Trümper et al.

[11] Patent Number: 4,693,661

[45] Date of Patent: Sep. 15, 1987

[54] CONNECTING ELEVATOR

[75] Inventors: Reinhard Trümper, Ratekau; Robert Baschant, Lübeck, both of Fed. Rep. of Germany

[73] Assignee: O & K Orenstein & Koppel AG, Fed. Rep. of Germany

[21] Appl. No.: 910,267

[22] Filed: Sep. 19, 1986

Related U.S. Application Data

[63] Continuation of Ser. No. 570,498, Jan. 13, 1984, abandoned.

[30] Foreign Application Priority Data

Jan. 29, 1983 [DE] Fed. Rep. of Germany ..... 3303059

[51] Int. Cl.[4] ..... B65G 47/58; B65G 41/00; B65G 17/02

[52] U.S. Cl. ..... 414/595; 105/241.2; 198/307.1; 414/599

[58] Field of Search ..... 414/595–598, 414/657, 658, 630, 680, 688, 694, 476, 376–379, 387, 388, 599; 198/307.1, 311, 314, 320; 105/241.1, 241.2, 268

[56] References Cited

U.S. PATENT DOCUMENTS

| | | | |
|---|---|---|---|
| 500,936 | 7/1893 | Northway et al. | 414/595 |
| 937,764 | 10/1909 | Bunnell | 414/597 |
| 1,013,229 | 1/1912 | Snead et al. | 414/595 X |
| 1,368,456 | 2/1921 | Robertson | 414/595 X |
| 1,504,034 | 8/1924 | Erwin | 414/598 |
| 1,833,192 | 11/1931 | Waterman, Jr. | 198/311 |
| 2,253,265 | 8/1941 | Cornett | 414/597 |
| 2,431,047 | 11/1947 | Jones | 414/598 |
| 2,484,709 | 10/1949 | Heath | 414/597 X |
| 2,700,482 | 1/1955 | Erickson | 414/598 |
| 3,771,677 | 11/1973 | Pilch | 414/688 |
| 4,006,833 | 2/1977 | Neukom et al. | 414/476 |
| 4,359,207 | 11/1982 | Maryonovich et al. | 198/320 X |
| 4,402,392 | 9/1983 | Fabian et al. | 198/311 |

FOREIGN PATENT DOCUMENTS

| | | | |
|---|---|---|---|
| 653097 | 11/1937 | Fed. Rep. of Germany | 414/596 |

*Primary Examiner*—Joseph E. Valenza
*Assistant Examiner*—David A. Bucci
*Attorney, Agent, or Firm*—McGlew and Tuttle

[57] ABSTRACT

A connecting elevator for serving, handling or working units which operate on mine benches of different level, comprises a supporting structure carrying a hoisting equipment and being supported, at least at its upper end for travelling on a bench, with the hoisting equipment comprising hoisting vessels running on rails and suspended from ropes whose winches are mounted on the upper end of the supporting structure.

3 Claims, 8 Drawing Figures

CONNECTING ELEVATOR

This application is a continuation, of application Ser. No. 570,498, filed Jan. 13, 1984, now abandoned.

FIELD AND BACKGROUND OF THE INVENTION

This invention relates in general to material transporting devices and in particular to a new and useful connecting elevator for operation with mining and similar units on benches of different levels.

In German No. OS 29 43 525, a connecting elevator for conveying or working units is described and shown, comprising a bridge by which at least two benches can be connected to each other and which is supported on both its ends and is equipped, at least at the upper bench, with a swivelling crawler or the like. The bridge rests by its upper end on the facing end of a belt bridge extending to both sides of the crawler and carried on a conveyor vehicle. The bridge may be supported on the conveyor vehicle, particularly through a universal joint, for pivoting about a vertical axis. At its lower end, the bridge is pivotable and lengthwise displaceable on a crawler and equipped with a crushing machine in the feed area, for crushing the supplied material. The bridge carries a steep conveyor including a belt and a cover belt. This connecting elevator must be equipped at its lower end with the heavy crusher, which requires a correspondingly heavy travelling undercarriage at the lower end of the bridge.

German No. OS 14 05 561 starts from inclined two-section elevators, such as haulage ways in mines, braking inclines, stationary cableways and other mechanisms equipped with hoisting vessels, such as cars, buckets, etc., which run on rails in reciprocating motion on ropes. Such mechanisms are firmly connected to the bedrock or ground and can be displaced from one location to the other only with difficulties, by means of special equipment. They can therefore be employed only to a limited extent.

German Pat. No. 306,908 discloses a method and device for conveying brown coal from open pit mines, and it is stated in the introduction that the inclined planes of the chain conveyor or the supporting columns and deflecting stations of the cableways are disturbing. The hoisting cars of this reference travel over a displaceable framework and one or more movable bridges connected thereto and extending up to the boundaries of the mine. The displaceable framework may be placed between two excavator paths, and advances with the worked coal face, in a manner known per se, as is done with excavator rails. German Pat. No. 309,385 discloses another development of the same method and device, wherein a displaceable single rail framework and a bridge extending up to the limit of the mine are provided at each end of the workings including one, two or even more adjacent excavator tracks or paths. The conveying cars travel on a containuous track over both structures and along the entire working way of the excavator. These mechanisms again have the drawback that even though one part, namely the framework for the conveyor vehicle, is displaceable, the other parts of the equipment are stationary and thus fixedly mounted.

SUMMARY OF THE INVENTION

The present invention is an improvement over the above designs and is directed to a mechanism capable of conveying coarse extracted material with minimum costs from a lower bench to a higher bench, and requiring no additional equipment for loading and unloading, particularly no crushers or the like.

The design is to be such that the connecting elevator may connect directly to a working machine operating on the lower bench, such as a power shovel, or a handling equipment, such as a large dumper, dragline bucket, etc., or be capable of receiving material therefrom, with the material being discharged at the upper end of the connecting elevator and conveyed for treatment or use.

The inventive elevator eliminates the necessity of employing trucks which had to overcome the difference in height between the benches.

Accordingly it is an object of the invention to provide an improved connecting elevator for operating with units on benches of different levels which comprises a support frame which is adapted to be positioned on a first bench which has a pivot support bearing and a supporting structure pivotably supported intermediate its length on said pivot support bearing which has an end which may be lowerable to a position on a second bench at a different level and includes a rail trackway extending therealong over which a cargo vessel is movable under the control of hoisting equipment which is associated with the support frame or supporting structure.

A further object of the invention is to provide a connecting elevator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figures 1, 5:
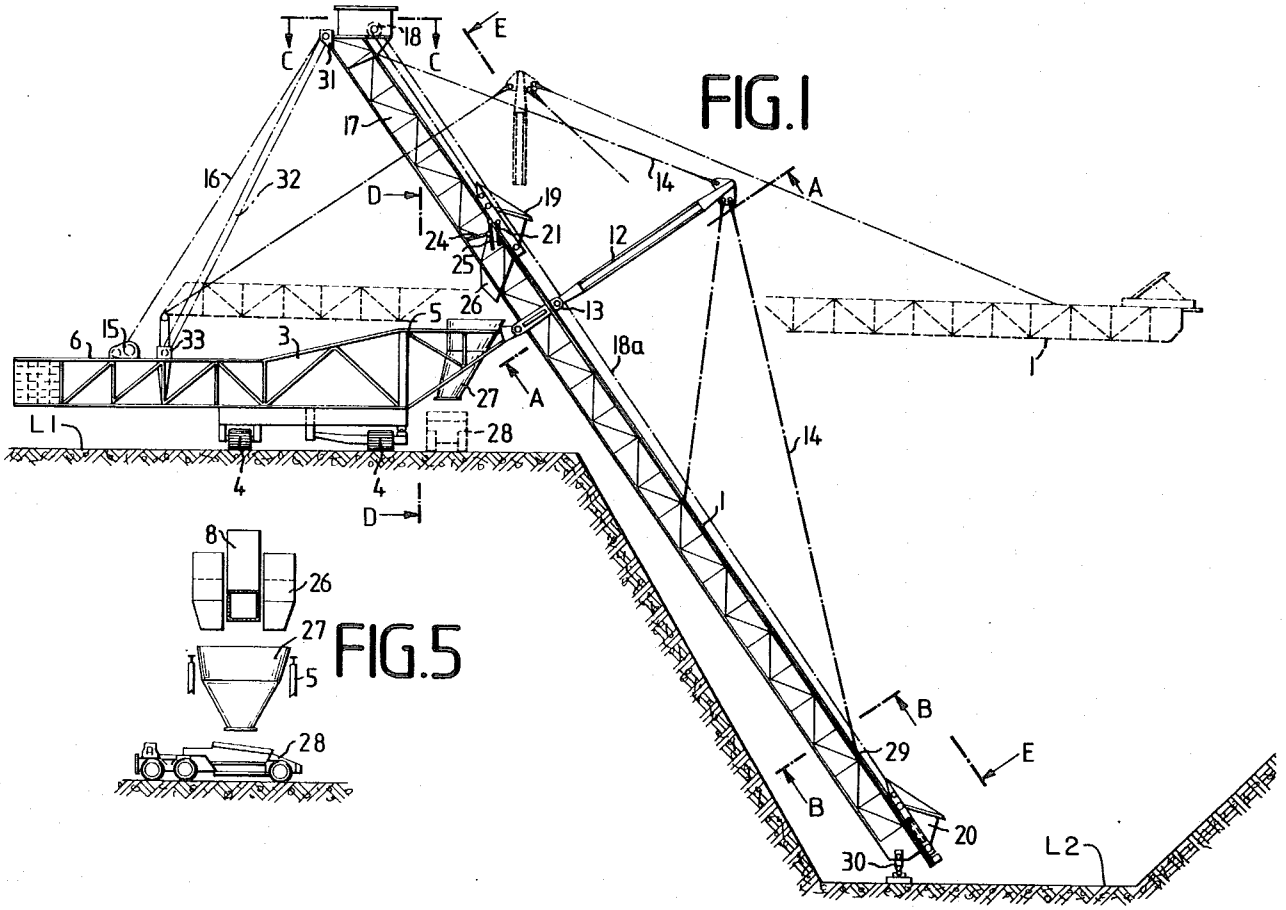
FIG. 1 is an elevational side view of a connecting elevator.
FIG. 5 is a sectional view taken along the line D—D of FIG. 1 at the discharge station.
Figure 2:
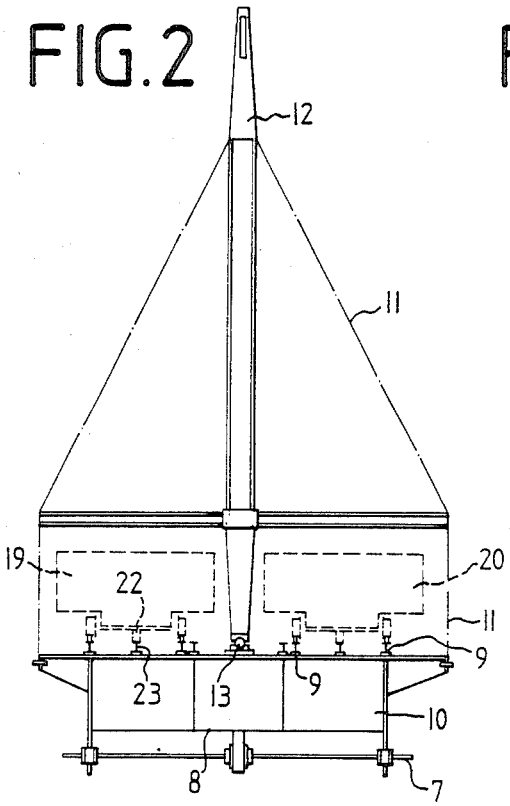
FIG. 2 is a sectional view taken along the line A—A of FIG. 1.
Figure 3:
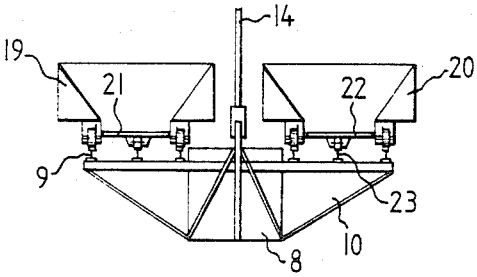
FIG. 3 is another sectional view taken along the line B—B of FIG. 1.
Figure 4:
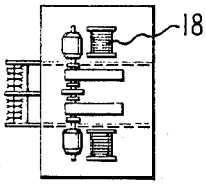
FIG. 4 is a sectional view taken along the line C—C of FIG. 1, at the upper end of the supporting structure.
Figure 6:
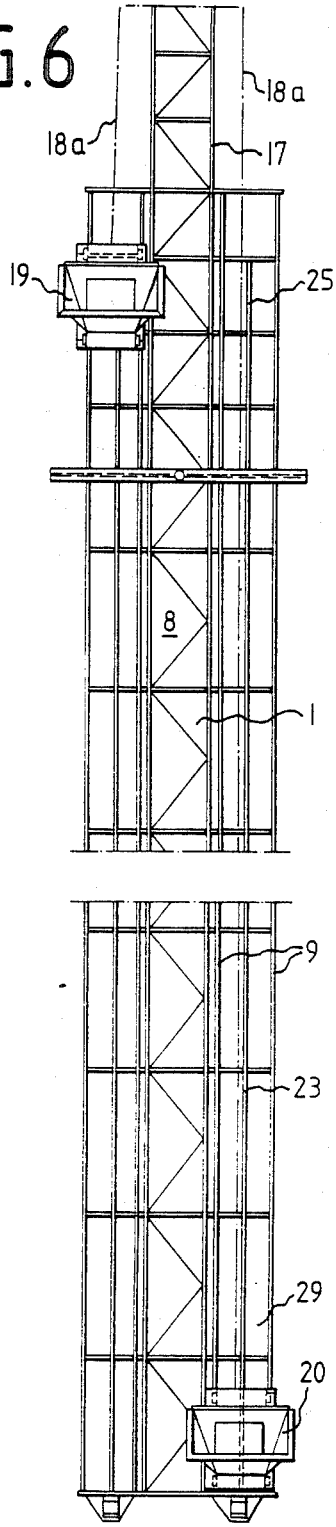
FIG. 6 is a top plan view of the supporting structure with the rails, or a view taken along the line E—E of FIG. 1.

Referring to the drawings in particular the invention embodied therein comprises a connecting elevator for operation with units one of which is on a first bench or level L1 and the other of which is on a second bench or level L2. The elevator includes a support frame 3 which is on level L1 and which may for example be moved about on a truck or similar vehicle having tracks 4. The support frame includes a pivot support bearing 7 on which is supported the supporting structure 1 and which is shown as comprising a box beam 8. The support structure 1 has a lower portion or end 29 which may be positioned at the second bench at level L2. The support structure 1 has a trackway or trackways 9 over which one or more vehicles or hoisting vessels 19 or 20 may move. Hoist means 18 are associated with the supporting structure 1 and the frame 5 for moving the vessels 1 along the trackway for example to bring material from level L2 up to the hopper 27 into which it is dumped at level L1.

The supporting structure 1 of the connecting elevator rests on supporting frame 3 designed for travelling on the upper bench L2. Supporting frame 3 is carried, in a manner known per se, at three points on a crawler having tracks 4. At the slope side, supporting frame 3 includes a bracket 5, and at the opposite side, a counterweight arm 6. Supporting structure 1 rests on bracket 5 through horizontal bearing 7.

Supporting structure 1 comprises a box beam 8 to which side portions 10 carrying rails 9 are secured. Each side portion 10 is connected by bracing ropes 11 to the uppr end of a strut 12 which is hinged at 13, in the zone of bearing 7, to supporting structure 1, more particularly to box beam 8. Other bracing ropes 14 lead from the top of strut 12 to the upper and lower ends of supporting structure 1. These ropes 14 may extend centrally or laterally.

On counterweight arm 6, a cable winch 15 is mounted, carrying a cable 16 which leads to a cable pulley head 31 mounted on the upper end 17 of supporting structure 1. This acts as hoist means for the structure 1. Head 31 is connected through a plurality of cable sections 32 to a cable pulley head 33 which is provided on counterweight arm 6. By means of winches 15, supporting structure 1 can be pivoted about bearing 7 into any desired position.

At the upper end 17 of supporting structure 1, hoisting winches 18, 18 of hoisting ropes 18*a* leading to hoisting vessels 19, 20 are mounted. Winches 18 are drivable independently of each other. In another embodiment, winches 18 may be coupled to each other in a manner such that vessels 19, 20 running on rails are hoisted and lowered in opposite directions.

Rails 9 may be designed to converge in the lower portion 29 of supporting structure 1 without the interposition of a switch, or through a switch, to a common endpiece, so that in their lowermost position, all the hoisting vessels 19, 20 arrive at the same location.

Hoisting vessels 19, 20 are provided with downwardly swingable bottom gates 21 which, in the shown embodiment, are drivable indirectly. Bottom gates 21 are further provided with back-up rollers 22 applying against rails 23 which are secured to supporting structure 1 between rails 9. In the upper portion of supporting structure 1, where the discharge area is provided, rails 23 are interrupted and replaced by rail lengths 25 which are pivotable by means of a hydraulic mechanism 24. If rail lengths 25 are swung out into the position shown in FIG. 1, the bottom gate 21 of a hoisting vessel 19 travelling upwardly opens in the discharge area so that the conveyed material falls into a chute 26 and passes through a hopper 27 to trucks 28 which are in standby position therebelow. Instead of trucks, conveyors may be provided. In such cases, a crusher may be provided in the area between chute 26 and the conveyors.

Bottom gates 21 may be held closed through back-up rollers 22, or directly by rails 9, so that separate back up rails 23 may be omitted.

It is advantageous to provide a plurality of back-up rollers 22 to ensure that bottom gates 21 remain closed even if the rails are interrupted.

On its lower end 29, supporting structure 1 is equipped with an extensible rest leg 30. Instead of the leg a crawler may be provided.

The material taken up by the working machine (not shown) is transferred to the lower end 29 of supporting structure 1 and discharged directly into a respective hoisting vessel 20 standing by in the lowermost position.

Upon lifting supporting structure 1, the connecting elevator can be displaced to any location of an exploitable mine, to be lowered again in a way so as to establish a connection between upper and lower benches.

Figures 7, 8:
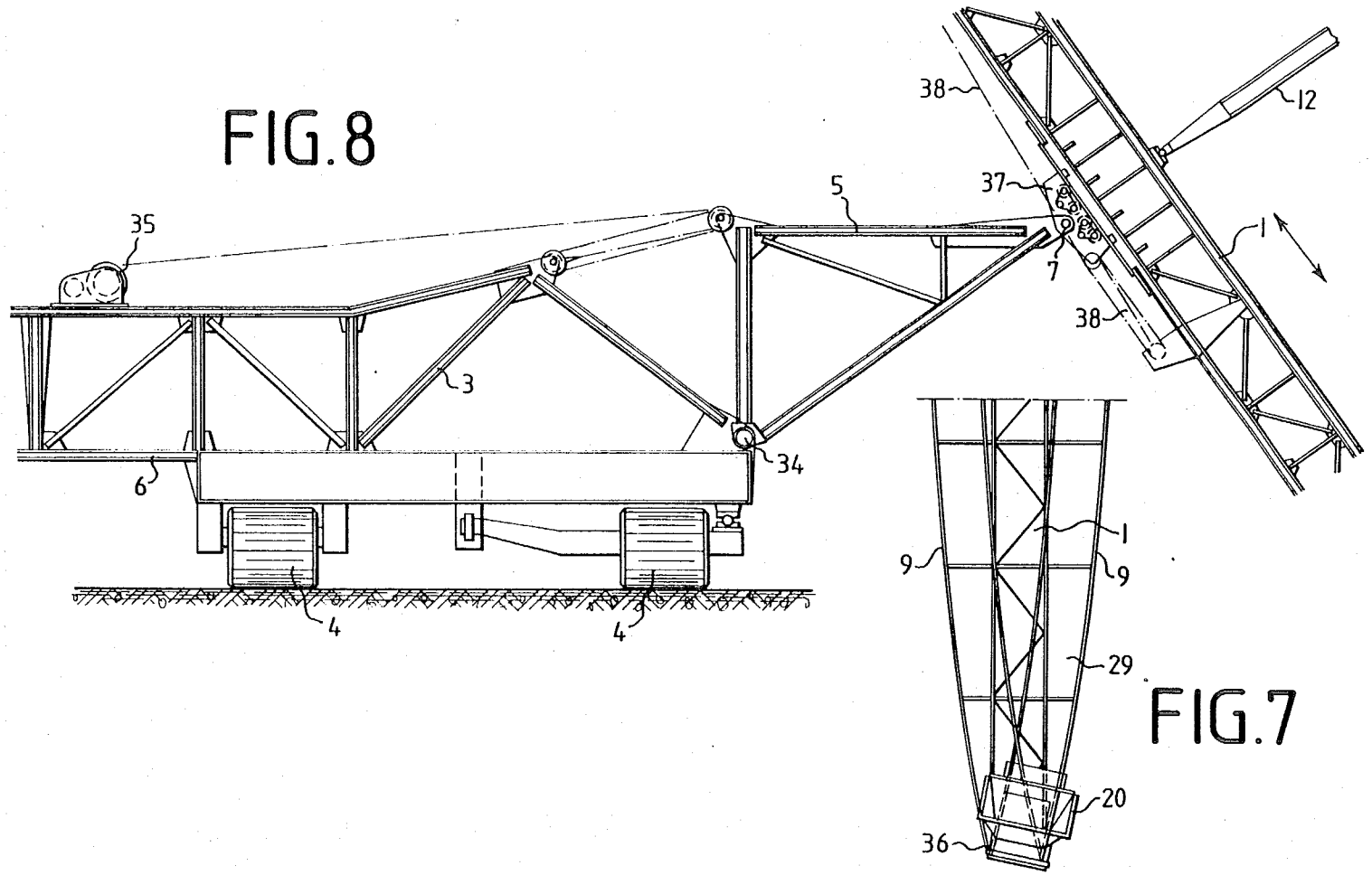
FIG. 7 shows another design of the lower end of the supporting structure.
FIG. 8 is a detail view of FIG. 1.

FIG. 7 shows another embodiment in which rails 9 converge at the lower end 29 to an end piece 36. This has the advantage that all of hoisting vessels 19 and 20 arrive at substantially the same loading place. The rail strands may remain closed in themselves and intersect. In another embodiment the rail strands may be united to a common end piece through a switch.

FIG. 8 shows a detail of FIG. 1, namely an embodiment in which bracket 5 is hinged to supporting frame 3 by means of a horizontal bearing 34. Bracket 5 is connected to supporting frame 3 through a hoist mechanism 35 such as a hydraulic device, ropes, etc., so that horizontal bearing 7 of supporting structure 1 can be moved along a circular path. This makes it possible to bring supporting structure 1, within limits, into various positions in height.

Another manner of adjusting the position in height of supporting structure 1 is to provide a swing bracket 37 which is pivotable about the horizontal axis of bearing 7 and support structure 1 for axial motion through rollers. Another hoist device 38 such as ropes and pulleys shown, is provided to shift supporting structure 1 in the longitudinal direction shown by the double arrow in FIG. 8.

In still another embodiment of the mechanism for adjusting the level of supporting structure 1, the entire superstructure of supporting frame 3 may be pivotable about a horizontal axis which extends in the travelling direction of the crawler in the zone of the crawler track 4 at the slope side. In this case, the superstructure of supporting frame 3 must be provided with a control device acting on the crawler in the zone of the other crawler track 4*a*.

In another embodiment of the invention, the lower end 29 of the supporting structure 1 is telescopically extensible in the direction of the double arrow in FIG. 8, so that supporting structure 1 can be extended or reduced in length in its lower portion. This is a simple way of displacing the lower receiving area of structure 1 laterally.

The invention relates to a connecting elevator for operation with units on benches of different levels, comprising a support frame adapted to be positioned on a first bench, and having a pivot support bearing, a supporting structure pivotally supported intermediate its length on said pivot support bearing and having an end which is positionable on a second bench when said support structure is pivoted on said support frame, a rail trackway extending along said supporting structure, a cargo carrying vessel movable along said trackway, and hoist means associated with said supporting structure for moving said vessels along said trackway.

While specific embodiments of the invention have been shown and described in detail to illustrate the application of the principles of the invention, it will be understood that the invention may be embodied otherwise without departing from such principles.

We claim:

1. A mine material elevator for operation on benches at different levels of a mine, comprising:

a crawler vehicle adapted to be positioned on a higher one of the benches;

a support frame (3) mounted on said vehicle, said support frame having a horizontal pivot support bearing (7) at one end thereof and a counterweight arm (6) on an opposite end thereof extending outwardly of said vehicle;

a swing bracket (37) pivotally mounted at said horizontal pivot support bearing to said support frame;

rollers rotatably mounted to said swing bracket;

an elongated support structure (1) mounted for rolling on said rollers of said swing bracket and parallel to a longitudinal axis of said elongated support structure for pivotally and displaceably connecting said elongated support structure to said support frame, said elongated support structure having a first end which is positionable on a lower one of the benches when said support structure is pivoted on said frame, said support structure having a second end on an opposite side thereof from said first end;

a pair of side by side rail trackways (9) extending along a top surface of said support structure from said first end toward said second end;

a back-up rail (23) extending along said trackways;

a cargo carrying vessel (19, 20) movable along said trackways, each vessel includes a hinged bottom and a back-up roller connected to each hinged bottom and engaged with said back-up rail for holding each hinged bottom closed;

a chute (26) connected to said support structure between said second end thereof and said swing bracket;

interruption means connected to each back-up rail for interrupting each back-up rail in the vicinity of said chute for opening said hinged bottom of each vessel above said chute for depositing contents of each vessel into said chute, said interruption means comprising each back-up rail having a movably mounted rail length (25) and a hydraulic mechanism (24) operatively connected to each rail length for moving each length away from a remainder of its respective back-up rail (23);

at least one first winch connected to said support structure at said second end thereof;

a hoisting rope connected to each of said vessels and operatively connected to said one first winch for raising and lowering said vessels along their trackways;

a second winch (15) connected on said counterweight arm adjacent said opposite end of said support frame;

a winch cable operatively connected between said second winch and said second end of said support structure for lowering and raising said second end of said support structure to raise and lower said first end of said support structure as said swing bracket pivots on said horizontal pivot support bearing;

a counterweight connected to said counterweight arm at said opposite ends of said support frame for counterweighting said support structure; and a hoist mechanism (38) connected between said support structure and said swing bracket for moving said support structure parallel to its longitudinal axis and along said swing bracket.

2. A mine material elevator according to claim 1, including a hopper (27) connected to said support frame adjacent said one end thereof and between said horizontal pivotal support bearing and said crawler vehicle, said hopper being positioned below said chute for receiving material from said chute.

3. A mine material elevator according to claim 2, wherein said side by side trackways converge at said first end of said support structure so that each vessel on its trackways comes to substantially the same position at said first end of said support structure, said hoisting ropes being connected to said at least one first winch so that said vessels move simultaneously in opposite directions on their trackways, one vessel being at said first end of said support structure when the other vessel is at said chute mounted on said support structure.

* * * * *